United States Patent [19]

Ferro

[11] 4,129,998

[45] Dec. 19, 1978

[54] EARRING

[75] Inventor: Nicholas J. Ferro, Johnston, R.I.

[73] Assignee: Ferro Novelty Company, Inc., Johnston, R.I.

[21] Appl. No.: 804,301

[22] Filed: Jun. 7, 1977

[51] Int. Cl.[2] ..... A44C 7/00

[52] U.S. Cl. ..... 63/12; 24/215; 24/230 R

[58] Field of Search ..... 63/12, 13; 24/213 C, 24/215, 107, 101 W, 230

[56] References Cited

U.S. PATENT DOCUMENTS

| | | | |
|---|---|---|---|
| 2,197,590 | 4/1940 | Place | 24/213 C |
| 3,275,973 | 9/1966 | Shlesinger | 24/230 R |
| 3,446,033 | 5/1969 | Driscoll | 63/12 |

*Primary Examiner*—F. Barry Shay
*Attorney, Agent, or Firm*—Barlow & Barlow

[57] ABSTRACT

An earring for a pierced ear having a means for attaching an ornament to a pierced ear which means is a resilient device having two parts compressible towards each other as they pass through the piercing in the ear and which, after passing through the piercing in the ear, expands under their own resiliency to hold the device in the lobe of the ear, the positioning of the ornament by means of this device being by merely pushing the device through the piercing in the ear or for detaching from the ear merely pulling on the device to pull it out of the ear.

4 Claims, 4 Drawing Figures

EARRING

BACKGROUND OF THE INVENTION

Different devices have been provided for attaching an ornament to an ear lobe having a piercing therethrough. Usually a straight pin passes through the piercing in the ear and a clutch is provided on the inside of the ear lobe to hold in place the pin which passes through the ear. In some cases a single wire bent in a certain form is manipulated through the ear so that the bend in the wire prevents withdrawing the wire through the piercing in the ear except by special manual manipulation, as in U.S. Pat. No. 3,446,033. The passing of a resilient bent member through a buttonhole to hold a shirt stud in position has been utilized over one hundred years ago in U.S. Pat. No. 161,668 in which the bending of the wire for passing through the buttonholes is so designed as to prevent the stud from being accidentally detached from the buttonholes.

SUMMARY OF THE INVENTION

A hard drawn wire is bent by being doubled back upon itself with a straight portion to attach at one end to an ornament while the end distant from the end attached to the ornament is doubled back to provide a bent back arm that will be compressible toward the portion attached to the ornament and, under its normal unflexed condition, will extend at an acute angle from the part attached to the ornament. The arm is then bent again on an obtuse angle to extend across the part attached to the ornament, thus providing a hump intermediate its ends, so that, when the device attached to the ornament is pushed through the piercing in the ear, the parts will flex towards each other and after the hump has passed through the lobe of the ear the two parts will spring away from each other thus locking the device in position. For withdrawal it is merely necessary to pull the ornament away from the ear and the attaching means will compress as it comes outwardly from the piercing in the ear.

DESCRIPTION OF THE PREFERRED EMBODIMENT

Figure 2:
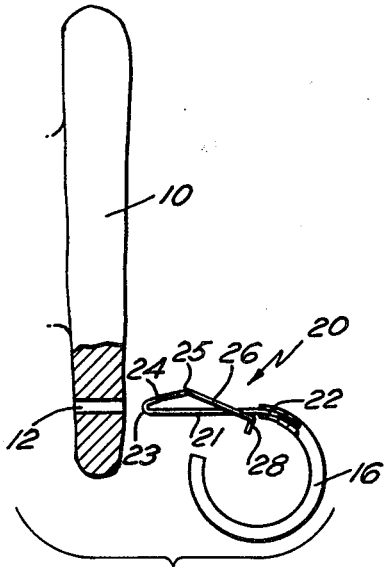
FIG. 2 shows an enlarged edge view partly in section of an ear with a piercing therein and an ornament with the attaching means secured thereto in a position to pass through the piercing in the ear lobe.

The ear ring to be attached to the human ear 10 in FIG. 2 has the ear lobe 11 pierced as at 12 for receiving an ornament 16 and an attaching means 20.

Figure 1:
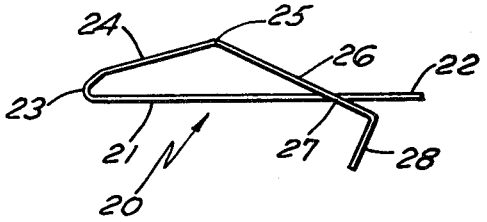
FIG. 1 is an enlarged view of the attaching means alone.

The ornament to be attached to the outside surface 15 of the ear is designated generally 16 and may be of any shape or form. The attaching means is designated generally 20 and is formed of what might be termed piano wire, which is relatively stiff and of cylindrical or other cross section, and has a straight functionally rigid member 21 having an end 22 which may be attached to the ornament 16, such as by solder, compression or other suitable means, to permit the rigid member 21 to extend from the ornament. This rigid wire is bent at its end distant from its attaching end 22 as at 23 at an acute angle to the straight member 21 so that its bent back arm 24 angles away from the straight portion 21 at an acute angle for a certain distance and then is bent again at an obtuse angle as at 25 from the arm 24 providing a portion 26 which will extend across the straight rigid portion 21 and is further bent at the point of crossing 27 to provide a finger 28 as seen in FIG. 1.

Figure 3:
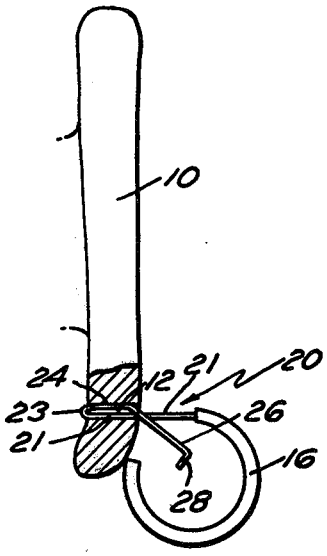
FIG. 3 is a view similar to FIG. 2 showing the attaching device in the act of being passed through the piercing in the ear lobe.
Figure 4:
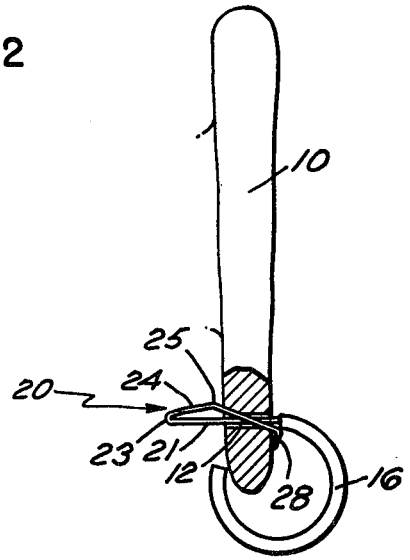
FIG. 4 is a view similar to FIG. 3 but showing the attaching means as passed completely through the ear lobe and in a position to be held in the ear lobe.

With the end portion 22 attached to the ornament 16 to position the ornament on the ear lobe, it is merely necessary to pass the acute angle portion 23 into the piercing 12 pushing straight through the piercing and as the device is passed through the piercing in this manner, the arm 24 will flex at the acute angle 23 as is shown in FIG. 3 so that the parts 21 and 24 move toward each other to provide a minimum dimension as the attaching means passes through the piercing in the ear lobe as shown in FIG. 3. By continued pressure on the ornament, the attaching means passes through the ear lobe until the hump 25 is on the inside of the ear lobe, and at this point the straight rigid member and the arm then spring apart under their own inherent resiliency so that the hump 25 prevents accidental withdrawal of the attaching means back through the pierced portion of the ear and at the same time the finger 28 limits further insertion of the attaching means through the ear lobe by engaging the front side of the ear lobe as seen in FIG. 4.

However, in order to detach the ornament from the ear, it is merely necessary to pull on the ornament when the slope of portion 26 will cause the arm to collapse or move towards the straight member 21 and the resiliency will allow the arm 24 to compress towards the straight member permitting detachment. Thus the insertion and removal of the ornament from the ear lobe is simply by means of pushing on the attaching means in the direction to pass it through the piercing in the ear lobe or pulling on the ornament to withdraw the attaching means from the ear lobe, all very simply and accomplished by one hand and without the need for feeling around for any pin on the inside of the ear lobe to attach a clutch.

I claim:

1. In an earring the combination with an ornament therefor of an ear attaching means for mounting such ornament on the outer side of a pierced ear lobe and including means for increasing security against accidental disengagement from the ear, said attaching means comprising a first straight rigid member having one end fixed to such ornament and extending therefrom and an acutely bent back arm over said straight rigid member with a portion rising away from said member, then bent abruptly toward said rigid member crossing the same and terminating at a point therebeyond, said attaching means thus providing a hump at a location between said acute bend and the point of attachment of said member to said ornament and of a distance from said acute bend to pass thru said piercing in the ear lobe and engage the inner side thereof, said straight member and bent back arm being resiliently compressible toward each other upon forcing the same through the ear lobe piercing in either direction, said termination point being at a location to be exterior to the earlobe piercing when the earring is in mounted condition.

2. An earring as in claim 1 wherein said straight member and bent back arm are of one piece of material.

3. An earring as in claim 1 wherein the distance from said hump to the said point of crossing of the member is a distance to accommodate the thickness of the ear lobe at the point of piercing of the lobe.

4. An earring as in claim 1 wherein the arm at the crossing of the member extends to provide a finger at said termination point to engage the outer side of the ear lobe and acts to limit the insertion of the attaching means through the piercing of the ear.

* * * * *